US007727372B2

(12) United States Patent
Liu et al.

(10) Patent No.: US 7,727,372 B2
(45) Date of Patent: Jun. 1, 2010

(54) ANODIZING VALVE METALS BY SELF-ADJUSTED CURRENT AND POWER

(75) Inventors: Yanming Liu, Clarence Center, NY (US); Neal Nesselbeck, Lockport, NY (US); David Goad, Buffalo, NY (US); Barry Muffoletto, Alden, NY (US)

(73) Assignee: Greatbatch Ltd., Clarence, NY (US)

( * ) Notice: Subject to any disclaimer, the term of this patent is extended or adjusted under 35 U.S.C. 154(b) by 1124 days.

(21) Appl. No.: 11/164,751

(22) Filed: Dec. 5, 2005

(65) Prior Publication Data

US 2006/0196774 A1 Sep. 7, 2006

Related U.S. Application Data

(60) Provisional application No. 60/633,711, filed on Dec. 6, 2004.

(51) Int. Cl.
*C25D 11/00* (2006.01)

(52) U.S. Cl. ..... 205/106; 205/96; 205/108

(58) Field of Classification Search ..... 205/108, 205/96, 106

See application file for complete search history.

(56) References Cited

U.S. PATENT DOCUMENTS 3,563,863 A * 2/1971 Vierow ..... 205/138
3,640,854 A * 2/1972 Klein ..... 205/128
4,687,551 A 8/1987 Furneaux et al.
4,839,002 A 6/1989 Pernick et al.
4,859,288 A 8/1989 Furneaux et al.
4,936,957 A 6/1990 Dickey et al.
5,185,075 A 2/1993 Rosenberg et al.
5,211,832 A 5/1993 Cooper et al.
5,503,730 A * 4/1996 Osano et al. ..... 205/83
5,837,121 A 11/1998 Kinard et al.
6,231,993 B1 * 5/2001 Stephenson et al. ..... 428/472.1
6,267,861 B1 7/2001 Kinard et al.
6,368,485 B1 4/2002 Ue et al.
6,802,951 B2 10/2004 Hossick-Schott
2003/0141193 A1 * 7/2003 Hossick-Schott ..... 205/104
2004/0182717 A1 * 9/2004 Kinard et al. ..... 205/233

* cited by examiner

*Primary Examiner*—Harry D Wilkins, III
*Assistant Examiner*—Bryan D. Ripa
(74) *Attorney, Agent, or Firm*—Michael F. Scalise

(57) ABSTRACT

A method for anodizing valve metal structures to a target formation voltage is described. The valve metal structures are placed in an anodizing electrolyte and connected to a power supply that generates a source voltage to at least one current limiting device. If at least two current limiting devices are used, they are in series with the valve metal structures with the one current limiting device connected to at least one structure. The valve metal structures are then subjected to a current that decreases over time, a formation voltage that increases over time to a level below the voltage from the power supply and a power level that is self-adjusted to a level that decreases excessive heating in the structure. The invention also includes the components for the method.

17 Claims, 4 Drawing Sheets

ANODIZING VALVE METALS BY SELF-ADJUSTED CURRENT AND POWER

BACKGROUND OF THE INVENTION

In general, electrolytic capacitors comprise anodes and cathodes that are separated by a porous separator material impregnated with an ionically conductive electrolyte. The electrolyte is typically composed of water, solvent(s), salt(s) of weak inorganic or/and organic acids. The anodes are of a valve metal having its exterior surface coated with a film of the corresponding oxide serving as a dielectric. Valve metals include and are not limited to aluminum, tantalum, niobium, titanium, zirconium, hafnium, and alloys thereof. The valve metals can be in any conventional form. Examples include etched foil, sintered powders, or other porous structures.

Anodizing the valve metals in an appropriate anodizing electrolyte forms the oxide film. The film thickness increases with the anodizing voltage. The desired oxide film thickness is determined by a capacitor working voltage, operation temperature and other performance requirements.

Maximum anodizing voltage and quality of the oxide formed strongly depends on the valve metal, the anodizing electrolyte composition, and the anodizing protocol. The anodizing protocol refers to a series of voltage/current "on" and "off" sequences.

It is believed that locally excessive temperatures and insufficient material transport in porous valve metal bodies during anodizing (especially for anodization of high voltage, large, pressed and sintered tantalum powder anodes) causes breakdown during anodization or poor anode electrical properties. There have been numerous attempts to solve these problems by improving the heat and electrolyte transport between the anodes and the bulk electrolytes. Some of the prior art methods include: controlling the anodizing current density; mechanical, sonic, or ultrasonic agitation of the electrolyte; anodizing by combining control of voltage/current and controlled rest steps (U.S. Pat. No. 6,231,993 to Stephenson et al.); and controlled pulses of the voltage/current (U.S. Pat. No. 6,802,951 to Hossick-Schott). These methods require sophisticated electronics for current/voltage/power control and frequent on/off switches that increase anodizing time. Additionally, it is believed that the eruptive increase in current/voltage in the case of pulsed anodizing may cause early breakdown and poor oxide quality.

A pressed tantalum powder pellet is a porous structure. During the prior art anodization process based on controlling the current density, the tantalum pellet is oxidized to a desired formation voltage by applying a current to the pellet. An example of this prior art protocol is illustrated in FIG. 1 where the current is maintained (line 2) and the power and voltage increases (line 4) over time. Such a simple anodizing protocol may be adequate for low voltage anodization where the breakdown voltage is intended to be less than about 100 volts. For high voltage anodization, i.e., greater than about 100 volts, as the anodizing voltage increases, the temperature in the porous valve metal anode increases. The locally excessive temperature in the anode promotes oxide defects, gray-out, and early anodizing breakdown. This traditional method has been confirmed in U.S. Pat. No. 6,802,951 to Hossick-Schott.

In the '951 patent, Hossick-Schott writes, "Traditional methods of forming the oxide layers are described in the prior art, e.g., in U.S. Pat. Nos. 6,231,993, 5,837,121, 6,267,861 and in the patents and articles referenced therein. Typically, a power source capable of delivering a constant current and/or a constant potential is connected to the anode slug that is immersed in the electrolyte. The potential is then ramped up to a desired final potential while a constant current flows through the anode-electrolyte system."

An obvious variation of FIG. 1 was disclosed in the '951 patent. Hossick-Schott disclosed and claimed an anodization protocol having (1) the voltage rise to a predetermined level; (2) when the voltage rises the current remains constant, (3) when the voltage reaches the predetermined level, the current decreases; and (4) when the current and/or voltage are rising, being maintained or decreasing, the electrolyte composition is agitated.

An alternative anodization (formation) protocol for high voltage sintered tantalum anodes is disclosed by Stephenson et al. in U.S. Pat. No. 6,231,993. The '993 patent is assigned to Wilson Greatbatch Ltd., the assignee for this application. Stephenson et al. disclose (bracketed material added for clarity) the following anodization protocol, which is partially illustrated in FIG. 2:

An exemplary formation protocol for a sodium reduced tantalum powder pellet is as follows. Exemplary sodium reduction tantalum pellets are available from H. C. Starck Inc., Newton, Mass. under the "NH" family designation. In this exemplary protocol, the pellet has a weight of about eight grams and the desired target formation voltage is 231 volts. The formation electrolyte is of polyethylene glycol, de-ionized water and $H_3PO_4$ having a conductivity of about 2,500 μS[/cm] to about 2,600 μS[/cm] at 40° C. The formation protocol is as follows:

1. The power supply is turned on at an initial current [line 2] of 80 mA until the voltage reached 75 volts. The power supply is then turned off for about three hours.
2. The power supply is turned back on at 80 mA, 75 volts and to 115 volts. The power supply is then turned off for about three hours.
3. The power supply is turned back on at 49 mA, 115 volts and to 145. The power supply is then turned off for about three hours.
4. The power supply is turned back on at 49 mA, 145 volts and to 175. The power supply is then turned off for about three hours.
5. The power supply is turned back on at 40 mA, 175 volts and to 205. The power supply is then turned off for about three hours.
6. The power supply is turned back on at 36 mA, 205 volts and to 225. The power supply is then turned off for three hours.
7. The power supply is turned back on at 36 mA, at 205 volts and to 231. The pellet is held at 231 volts for about one hour to complete the formation process. The anodized pellet is then rinsed and dried.

If desired, the formation process is periodically interrupted and the anodized pellet is subjected to a heat treatment step. This consists of removing the anode pellet from the anodization electrolyte bath. The anode pellet is then rinsed and dried followed by heat treatment according to the procedure described by D. M. Smyth et al., "Heat-Treatment of Anodic Oxide Films on Tantalum", Journal of the Electrochemical Society, vol. 110, No. 12, pp. 1264-1271, December 1963.

The anodization protocol illustrated in FIG. 2 controls the current and decreases the heat generated in comparison to the protocol illustrated in FIG. 1. By decreasing the temperature rise, the FIG. 2 anodization protocol obtains an anode having decreased DC leakage. However, as with any protocol there is a desire to further improve the quality of the anodized valve metal. One way to measure the improved quality of an anodized valve metal is to determine if the DC leakage decreases. A decreased DC leakage indicates a better oxide formation on the valve metal and more stable performance of the subsequently built capacitor. Better oxide formation, in turn, is obtained by better heat dissipation in the valve metal during anodization.

In that respect, the present invention teaches a method of anodization that simplifies the equipment and process, reduces anodization time, and provides a better quality oxide. Although this invention is, in principle, applicable to all valve metal anodes, it is particularly useful for anodizing a high voltage sintered tantalum structure.

SUMMARY OF THE INVENTION

The present invention is directed to a method for anodizing valve metal structures to a target formation voltage. First, a valve metal structure is provided in an anodizing electrolyte. A power supply that generates a source voltage is connected to at least one current limiting device(s), and if at least two current limiting devices are used, the devices are in series to at least one valve metal structure. A first anodizing step is then performed by subjecting the structure to (a) a current that decreases over time, (b) a formation voltage that increases over time to a level below the voltage from the power supply and (c) a power level that is self-adjusted to a level that decreases excessive heating in the structure. The invention also includes the components for the method.

DETAILED DESCRIPTION OF THE INVENTION

The anodizing methods of the present invention apply to all valve metals for providing electrolytic capacitor anodes. The valve metal anodes include and are not limited to etched foils, pressed and sintered powder bodies, or other porous structure forms. The anodizing methods of the present invention are particularly useful for anodizing large and high voltage sintered powder anodes such as those used in tantalum electrolytic capacitors.

In that respect, the present invention discloses methods of anodizing valve metals in which the current and power are self-adjusted without or with brief interruptions during the anodization process. The claimed method offers the following advantages over the prior art: 1) controlled power throughout the course of anodizing to avoid excessive temperature at the valve metal structure; 2) a relatively short anodizing time; 3) a smooth change in current and power, thereby avoiding eruptive changes in current/voltage; and 4) simplified anodizing electronics and equipment, which results in a low cost anodizating protocol. The claimed anodizating protocol also results in improved anode electrical properties including lower DC leakage, more stable shelf life, improved charge/discharge energy efficiency, and improved stability during operation life. These properties are strongly desired for critical applications such as use of the anode in a capacitor powering an implantable cardioverter defibrillator.

Figure 1:
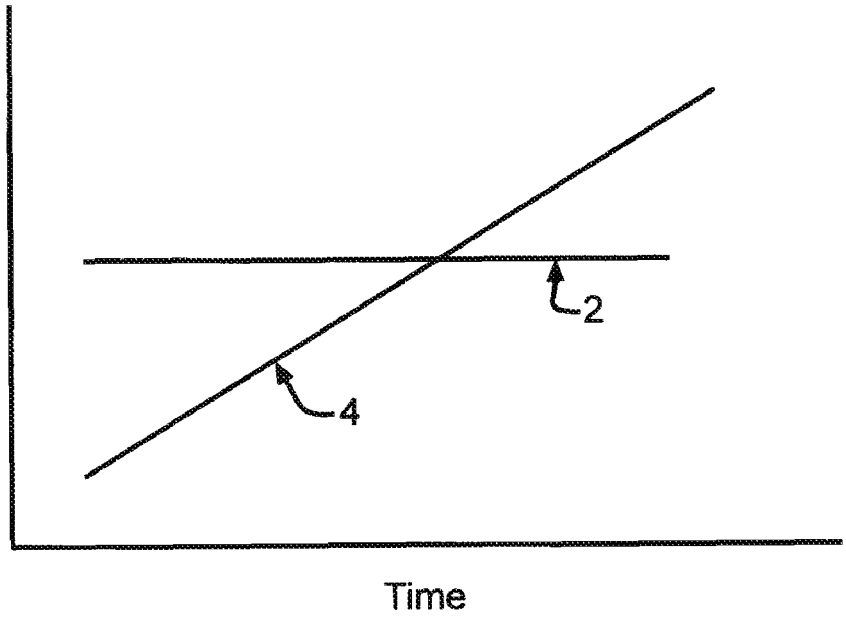
FIG. 1 Prior Art
FIG. 1 illustrates a representative anodizing protocol according to the prior art.
Figure 2:
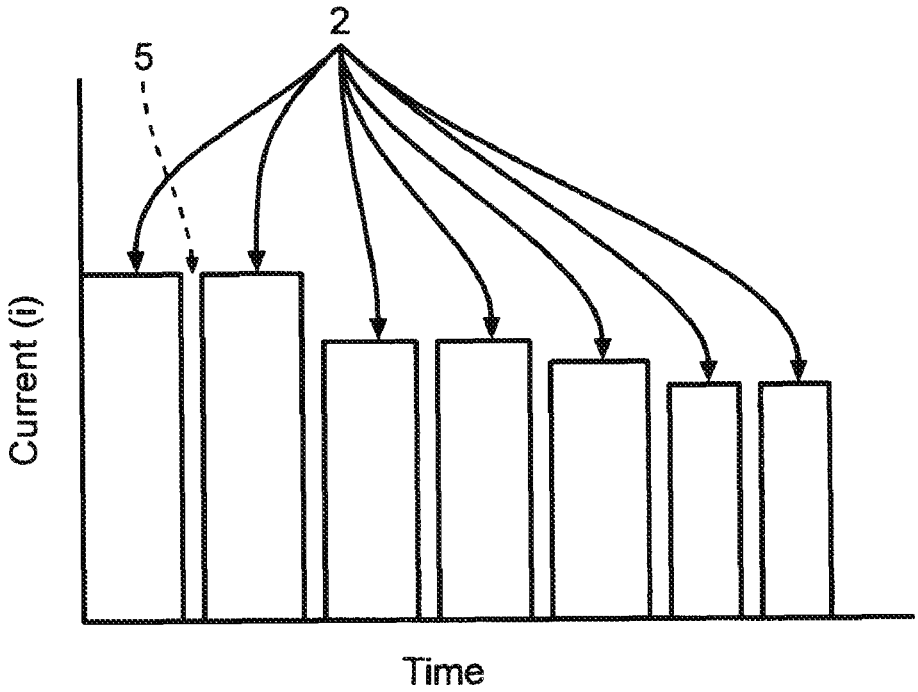
FIG. 2 Prior Art
FIG. 2 illustrates an anodizing protocol according to U.S. Pat. No. 6,231,993 to Stephenson et al.
Figure 3:
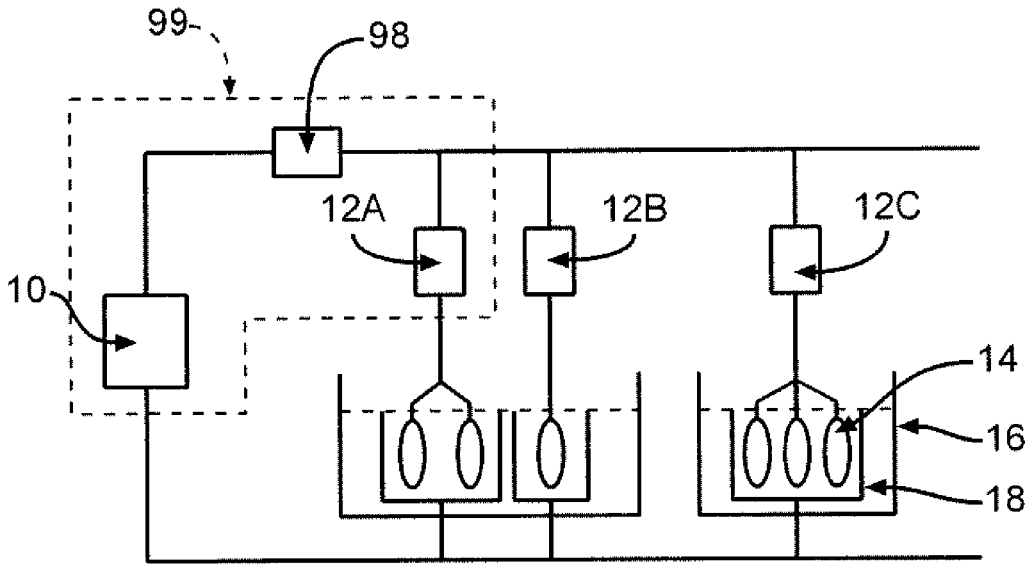
FIG. 3 illustrates an electrical schematic of the present invention.

The anodization apparatus of the present invention is illustrated in FIG. 3. A DC power supply 10 generates a supply voltage (V). The supply voltage traverses a circuit having at least one current limiting device(s) 12A, 12B, and 12C. The simplest current limiting device is a resistor; however, any device that is capable of limiting the current is contemplated by the scope of the invention. The resistor can be a fixed or variable unit. The current limiting devices 12A, 12B and 12C and the power supply voltage (V) determine the starting current and the current/voltage/power profile during anodizing.

At least one valve metal structure 14 is connected directly or through an electrical conduit to one of the current limiting devices 12A, 12B and 12C. The drawing illustrates several valve metal structures 14 contained within a conventional formation tank 16 provided with an anodizing electrolyte. The anodizing electrolyte can be any appropriate anodizing electrolyte.

An example of an effective anodizing electrolyte is disclosed in commonly assigned U.S. Pat. No. 6,231,993 to Stephenson et al. and comprises an aqueous solution of ethylene glycol or polyethylene glycol and $H_3PO_4$. An exemplary one comprises about 80 volume percent polyethylene glycol (PEG400) with a minor volume percent amount of $H_3PO_4$ and remainder de-ionized water, and has a conductivity of about 10 μS/cm to about 50,000 μS/cm at 40° C. Alternatively, other electrolyte compositions can be used that are designed to obtain desired anode properties.

There is at least one cathode 18 and conduit that returns the electrical power to the power source 10 to form the desired circuit needed for anodization.

Figure 4:
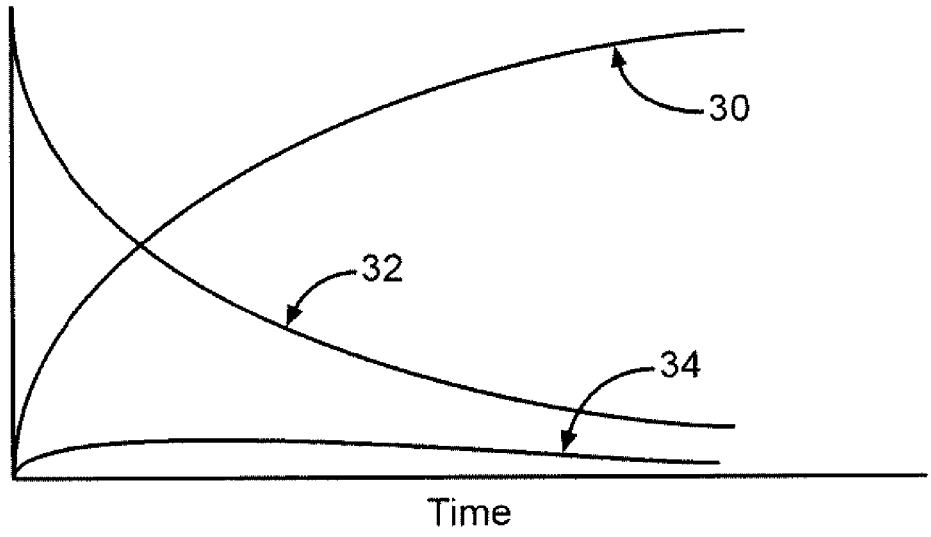
FIG. 4 illustrates the voltage 30, current 32 and power 34 curves of the present invention during a continuous anodization process.

In FIG. 4, the anode voltage (Vf) 30 increases with anodizing time while the current 32 decreases. Therefore, the power 34 to the anode is self-adjusted according to the anode voltage throughout the anodizing process. This self-adjustment is smooth and does not interrupt the anodizing process. That means there are no stop periods (rest or off-time) throughout the anodizing protocol. The control is simple with no sophisticated electronics.

The rate of rise of the anode voltage depends on the power supply voltage, mass of the anode, resistance of the resistor, and the anode micromorphology. The following equation is used to determine the power supply set voltage and resistor required for a desired anodizing time for a given size anode (g) and targeted anodization voltage (Vf):

$$\ln\left(\frac{V}{V - V_f}\right) = \frac{kt}{gR}$$

V=the power source set voltage $V_f$=the anode formation voltage (including IR drop due to electrolyte)

k=the formation rate constant depending on the type of valve metal and sinter conditions;

g=the mass of the valve metal t=the formation time

R=the resistance of the resistor or other current limiting devices

During anodization of a porous valve metal structure, formation voltage (Vf) increases and current decreases with time. The real surface area of a porous valve metal structure (e.g., sintered tantalum powder bodies) decreases with formation voltage as the oxide thickness increases. In other words, the real surface area is that which has not been anodized to the target formation voltage and remains available for anodization.

The above equation is for planar valve metal structures, such as valve metal foils, because their real surface area does not decrease as metal is consumed for oxide growth. Equations for non-planar surfaces (porous structures) are difficult to determine because the shape of the powder micro-particles cannot easily be defined as surface area is consumed or oxidized during anodization. In view of that, the formation rate constant (k) is actually not a constant and may increase with time. Therefore, the actual anodization characteristics for variously shaped structures are far more complicated than the formula shown above.

The above equation also indicates that a greater resistance in the resistor correlates with a longer formation time and lower wattage (power). Alternatively, a lower resistance results in a shorter formation time and higher wattage.

Figure 5:
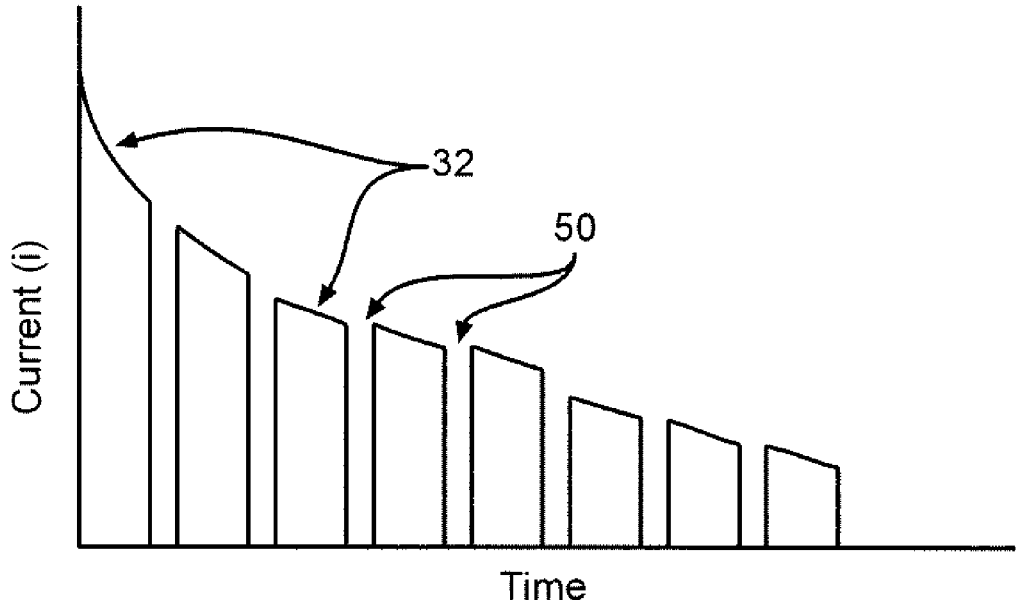
FIG. 5 illustrates a current profile having fixed on-times and off-times according to the present invention.

In FIG. 5, the addition of rest times 50 during anodization may be beneficial to the oxide quality. The rest time can be obtained by simply turning on and off the current. The appropriate rest time is obtained by incorporating a timing mechanism 98 within the circuitry area 99 between (and/or including) the power source and the current limiting device(s).

Figure 6:
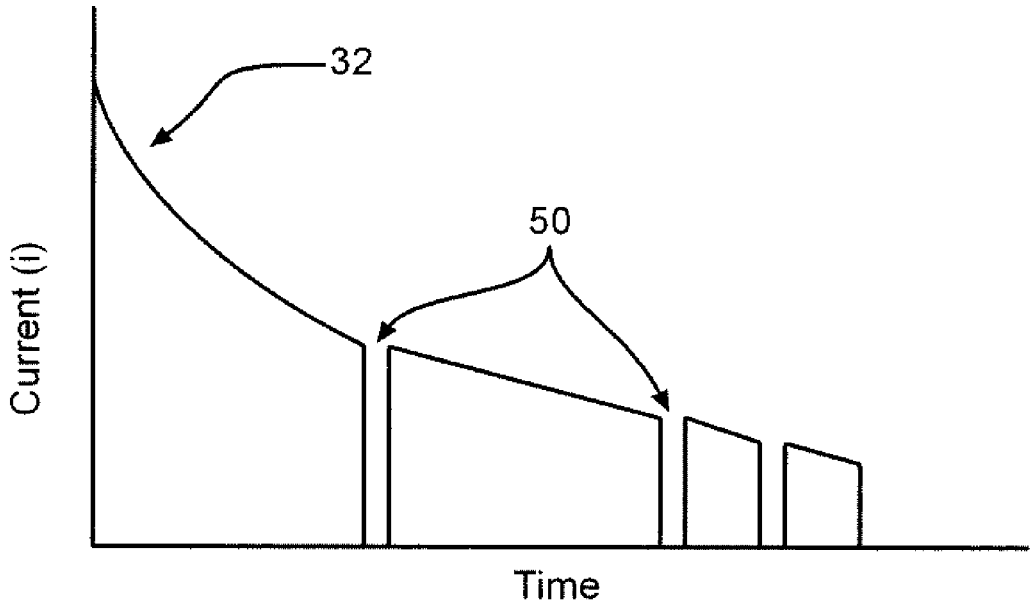
FIG. 6 illustrates a current profile having varied on-times and fixed off-times according to the present invention.

The on-times and off-times can range from seconds to hours. The on-times and off-times can be the same or different, preferably the off-time is shorter than the on-time. The on-time and off-times can be fixed or varied during the course of anodizing. FIG. 5 is an example of the anodizing protocol of the present invention with a fixed on-times 32 (five hours for example) and an off-time 50 (one hour for example). FIG. 6 illustrates an example of the anodizing method of the present invention with varied on-times 32 and fixed off-times 50. The on-time periods decrease in duration during the anodizing protocol while the off-time is fixed at one hour. Obviously, alternative embodiments may occur such as having the on-time decrease, be fixed, and/or increase with time and the off-times increase, decrease and/or be fixed with time.

The current limiting devices are in series with the anode because it is the simplest method of limiting the anodizing current and power. Alternatively, the anodizing current can also be controlled electronically (such as constant power, varied power, or controlled current), but that is not as simple as the present invention for a low cost and efficient manner to control temperature during an anodization protocol to obtain a desired anodization result.

The valve metals formed in accordance to the present invention are for over 100 V, preferably over 200 V.

EXAMPLES

Seven tantalum bodies or structures, each about 7 grams (QR3 powder manufactured by HC Starck), measured about 1.056 inches in diameter, had a 7.0 g/cc pressed density, and were exposed to a 1600° C./15 minutes sintering process. For a more detailed disclosure of the sintering process, reference is made to U.S. Pat. No. 6,965,510 to Liu et al., which is assigned to the assignee of the present invention and incorporated herein by reference. The anodizing electrolyte comprised about 80 volume percent PEG400 along with a few volume percent $H_3PO_4$ and remainder de-ionized water, and had a conductivity of about 100 μS/cm at 40° C. The initial power supply voltage was set at 415 volts.

After anodizing, each anode was heat-treated at about 440° C. for 90 minutes and reformed at about 390 volts for about one hour. The DC leakage was measured at about 360 volts at room temperature. All the anodes were formed to about 390 volts without any breakdown and gray-out.

Comparative Data

Five of the tantalum structures were anodized in accordance with the protocol set forth in U.S. Pat. No. 6,231,993 to Stephenson et al. The DC leakage data for the Comparative Anodes 1 to 5 is set forth in Table 1.

Present Invention Data

Figure 7:
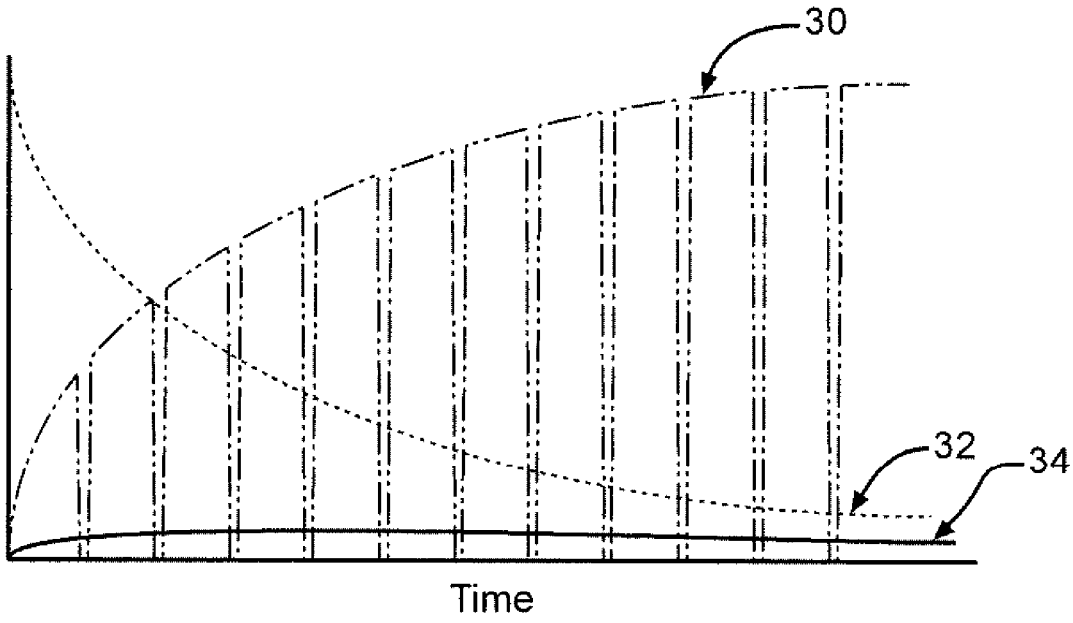
FIG. 7 illustrates the current, voltage and power curves for anodizing a tantalum anode according to the present invention.
Figure 8:
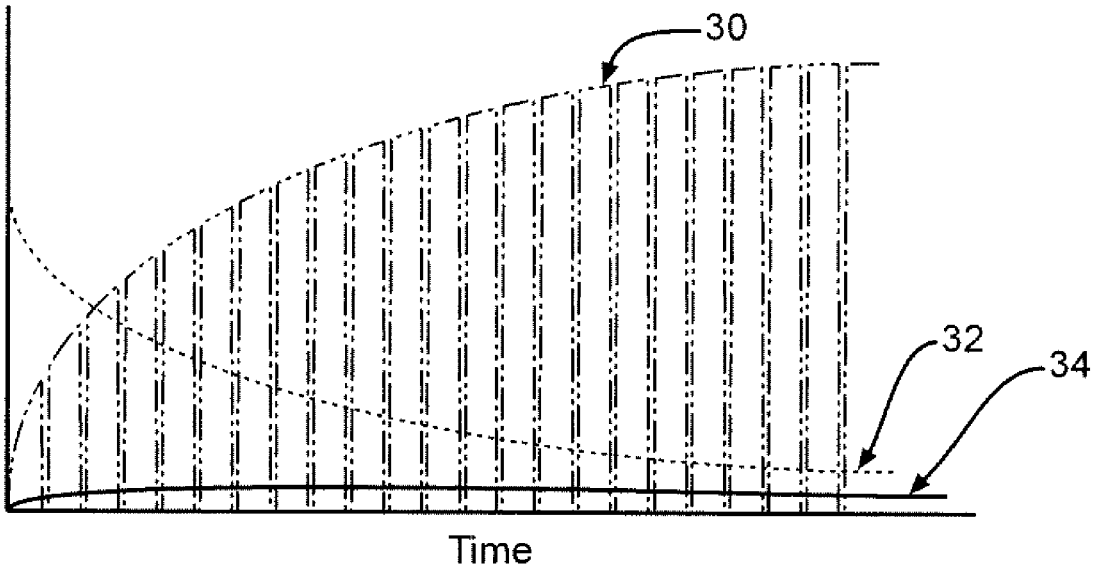
FIG. 8 illustrates the current, voltage and power curves for anodizing a tantalum anode according to the present invention.

The remaining two tantalum structures were anodized according to the present invention using different on/off times with a resistor of 5 k Ω. A 5 k Ω resistor was used to provide an initial formation current comparable to that used in the anodization protocol of U.S. Pat. No. 6,231,993 to Stephenson et al. For each tantalum structure, the current was recorded during formation, and the formation voltage and wattage were calculated based on current. Current in mA and the calculated formation voltage and wattage are shown in FIGS. 7 and 8 for the respective present invention anodes #1 and #2. FIG. 7 illustrates a protocol of 5 hours on and 2 hours off for 11 cycles; and FIG. 8 illustrates a protocol of 3 hours on and 1 hour off for 22 cycles. The off-times are not shown in either figure. The DC leakage results of these two anodes are set forth in Table 1.

TABLE 1

| Formation Protocol | 5 min DCL microamp |
|---|---|
| Comparative #1 | 36.7 |
| Comparative #2 | 23.3 |
| Comparative #3 | 31.8 |
| Comparative #4 | 30.9 |
| Comparative #5 | 24.1 |
| Present Invention #1 | 18.6 |
| Present Invention #2 | 20.8 |

The data presented in Table 1 clearly illustrates that the present anodization protocol obtains better oxide quality on valve metals than that afforded by the prior art. This is due to greater control of power applied to the tantalum structure during anodizing formation. The implication is that the teachings in U.S. Pat. No. 6,802,951 to Hossick-Schott that anodizating protocols for valve metal structures having "high potential, low current, formation conditions should be avoided or kept as short as possible" are not entirely accurate. While not intended to be held to a particular theory, it is believed that the superior results attributed to the present invention may be because the electrical schematic for anodizating valve metal structures has not been previously disclosed, as indicated by the prior art statement.

It is appreciated that various modifications to the present inventive concepts described herein may be apparent to those of ordinary skill in the art without departing from the spirit and scope of the present invention as defined by the herein appended claims.

What is claimed is:

1. A method for anodizing a valve metal structure to a target formation voltage, comprising the steps of:

a) providing the valve metal structure;

b) providing an anodizing apparatus comprising a power supply that generates a source voltage, a current limiting device, an anodizing electrolyte and a cathode;

c) providing the valve metal structure in the anodizing electrolyte with the valve metal structure being connected to the current limiting device; and d) anodizing the valve metal structure to the target formation voltage by subjecting the valve metal structure to a current from the current limiting device that continuously decreases over time as a formation voltage continuously increases over time according to the following equation:

$$\ln(V/(V-Vf))=kt/gR$$

wherein V is the source voltage; Vf is the anode formation voltage (including IR drop due to electrolyte); k is the formation rate constant depending on the type of valve metal and sinter conditions; g is the mass of the valve metal; t is the formation time; and R is the resistance of the current limiting device until the target formation voltage is reached without interruption of the anodizing process.

2. The method of claim 1 including providing the current limiting device as a resistor-type device.

3. The method of claim 1 including providing the electrolyte having a conductivity of about 10 μS/cm to about 50,000 μS/cm at 40° C.

4. The method of claim 1 wherein the electrolyte comprises an aqueous solution of ethylene glycol or polyethylene glycol and $H_3PO_4$.

5. The method of claim 1 including selecting the valve metal from one of the group consisting of tantalum, aluminum, niobium, titanium, zirconium, hafnium, and alloys thereof.

6. The method of claim 1 including providing the valve metal structure having a generally planar surface.

7. The method of claim 1 including forming the valve metal structure to over 100 V.

8. The method of claim 1 including providing two or more current limiting devices, each in series with a valve metal structure.

9. A method for anodizing a valve metal structure to a target formation voltage, comprising the steps of:

a) providing the valve metal structure;

b) providing an anodizing apparatus comprising a power supply that generates a source voltage, a current limiting device, an anodizing electrolyte and a cathode;

c) providing the valve metal structure in the anodizing electrolyte with the valve metal structure being connected to the current limiting device; and d) anodizing the valve metal structure to the target formation voltage by subjecting the valve metal structure to a current from the current limiting device that continuously decreases over time and a formation voltage that continuously increases over time according to the equation:

$$\ln(V/(V-Vf))=kt/gR$$

wherein:

V is the source voltage,

Vf is the anode formation voltage (including IR drop due to electrolyte), k is the formation rate constant depending on the type of valve metal and sinter conditions, g is the mass of the valve metal, t is the formation time, and R is the resistance of the current limiting device.

10. The method of claim 9 including providing a resistor as the current limiting device.

11. The method of claim 9 including providing the anodizing electrolyte having a conductivity of about 10 μS/cm to about 50,000 μS/cm at 40° C.

12. The method of claim 9 wherein the electrolyte comprises an aqueous solution of ethylene glycol or polyethylene glycol and $H_3PO_4$.

13. The method of claim 9 including selecting the valve metal from one of the group consisting of tantalum, aluminum, niobium, titanium, zirconium, hafnium, and alloys thereof.

14. The method of claim 9 including providing the valve metal structure having a generally planar surface.

15. The method of claim 9 including forming the valve metal structure to over 100 V.

16. The method of claim 9 including providing two or more current limiting devices, each in series with a valve metal structure.

17. A method for anodizing a valve metal foil to a target formation voltage, comprising the steps of:

a) providing the valve metal foil comprising at least one planar surface;

b) providing an anodizing apparatus comprising a power supply that generates a source voltage, a current limiting device, an anodizing electrolyte and a cathode;

c) providing the valve metal foil in the anodizing electrolyte with the valve metal foil being connected to the current limiting device; and d) anodizing the valve metal foil to the target formation voltage by subjecting the valve metal foil to a current from the current limiting device that continuously decreases over time and a formation voltage that continuously increases over time according to the equation:

$$\ln(V/(V-Vf))=kt/gR$$

wherein:

V is the source voltage,

Vf is the anode formation voltage (including IR drop due to electrolyte), k is the formation rate constant depending on the type of valve metal and sinter conditions, g is the mass of the valve metal, t is the formation time, and R is the resistance of the current limiting device.

* * * * *